US010099874B2

(12) United States Patent
Kuriki

(10) Patent No.: US 10,099,874 B2
(45) Date of Patent: Oct. 16, 2018

(54) SHEET CONVEYING APPARATUS

(71) Applicant: Brother Kogyo Kabushiki Kaisha, Nagoya (JP)

(72) Inventor: Yuichiro Kuriki, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 0 days.

(21) Appl. No.: 15/693,538

(22) Filed: Sep. 1, 2017

(65) Prior Publication Data

US 2018/0118482 A1 May 3, 2018

(30) Foreign Application Priority Data

Oct. 27, 2016 (JP) ..... 2016-211056

(51) Int. Cl.

*B65H 3/52* (2006.01)
*B65H 1/06* (2006.01)
*B65H 3/06* (2006.01)
*B65H 3/34* (2006.01)

(52) U.S. Cl.

CPC ..... *B65H 3/523* (2013.01); *B65H 1/06* (2013.01); *B65H 3/063* (2013.01); *B65H 3/0638* (2013.01); *B65H 3/0669* (2013.01); *B65H 3/0676* (2013.01); *B65H 3/0684* (2013.01); *B65H 3/34* (2013.01); *B65H 3/5238* (2013.01); *B65H 2701/1131* (2013.01); *B65H 2701/1914* (2013.01); *B65H 2801/39* (2013.01)

(58) Field of Classification Search

CPC . B65H 1/06; B65H 3/06; B65H 3/063; B65H 3/0676; B65H 3/34; B65H 3/46; B65H 3/5207; B65H 3/523; B65H 3/5238

USPC ..... 271/165

See application file for complete search history.

(56) References Cited

U.S. PATENT DOCUMENTS 4,575,068 A * 3/1986 Kato ..... B65H 3/5292 271/122
5,219,156 A * 6/1993 Mori ..... B65H 3/063 271/110
5,273,269 A * 12/1993 Iwanaga ..... B65H 3/5238 271/124
8,905,397 B2 * 12/2014 Le Gallo ..... G07B 17/00467 271/35

(Continued)

FOREIGN PATENT DOCUMENTS

JP 60044433 A * 3/1985 ..... B65H 3/5284
JP 4820314 B 11/2011

*Primary Examiner* — Prasad V Gokhale
(74) *Attorney, Agent, or Firm* — Burr & Brown, PLLC

(57) ABSTRACT

A sheet conveying apparatus includes: a supporter having a support surface configured to support sheets; a supplier having a conveying surface exposed from the support surface and moved to supply one or more sheets; a separator including a separating roller and a retard roller located downstream of the supplier; and an inclined surface disposed upstream of the nip position and pivotable about a pivot axis. The inclined surface has a first end portion and a second end portion, and the second end portion is located downstream of the first end portion. The inclined surface is inclined such that the second end portion is nearer to the support surface than the first end portion. The first end portion is located upstream of a downstream end portion of the conveying surface. The second end portion is spaced apart from the conveying surface.

16 Claims, 10 Drawing Sheets

(56) References Cited

U.S. PATENT DOCUMENTS

| | | | | |
|---|---|---|---|---|
| 2008/0203652 | A1 | 8/2008 | Yasukawa et al. | |
| 2013/0328260 | A1* | 12/2013 | Matsushita | B65H 5/068 271/109 |
| 2016/0167902 | A1* | 6/2016 | Cheng | B65H 3/5207 271/121 |
| 2017/0126912 | A1* | 5/2017 | Shuto | B65H 3/063 |

* cited by examiner

SHEET CONVEYING APPARATUS

CROSS REFERENCE TO RELATED APPLICATION

The present application claims priority from Japanese Patent Application No. 2016-211056, which was filed on Oct. 27, 2016, the disclosure of which is herein incorporated by reference in its entirety.

BACKGROUND

The following disclosure relates to a sheet conveying apparatus.

There is known a sheet supplying apparatus as one example of conventional sheet conveying apparatuses. This sheet supplying apparatus includes a chute, a set roller, a pressure roller, and a separating roller. The separating roller is generally called a retard roller.

The chute has an upper surface for supporting a sheet or sheets. The pressure roller presses the sheet supported on the upper surface of the chute, toward the set roller. The set roller is rotated while being in contact with the sheet supported on the upper surface of the chute, to convey the sheet to the downstream side in the conveying direction along the conveyance path. The supplied sheet is nipped between the separating roller and the set roller at a position located downstream of the pressure roller in the conveying direction. In the case where a plurality of sheets are supplied, the sheets are separated one by one at a nip position and conveyed by the set roller and the separating roller toward the downstream side in the conveying direction.

SUMMARY

In the above-described conventional sheet supplying apparatus, however, in the case where a plurality of sheets are supplied toward the nip position between the set roller and the separating roller, thin sheets or curled sheets easily results in misalignment of leading edges of the stacked sheets. This misalignment may cause variations in the number of sheets reaching the nip position and positions of the leading edges of the sheets, which may result in double feeding.

Accordingly, an aspect of the disclosure relates to a sheet conveying apparatus capable of reliably reducing double feeding of sheets.

In one aspect of the disclosure, a sheet conveying apparatus includes: a supporter having a support surface configured to support a plurality of sheets; a supplier having a conveying surface exposed from the support surface, the conveying surface being configured to supply one or more sheets supported by the support surface toward a downstream side in a conveying direction along a conveyance path by moving, in the conveying direction, in contact with the one or more sheets supported by the support surface; a separator including a separating roller and a retard roller which are located downstream of the supplier in the conveying direction, the separator being configured to separate one by one the one or more sheets supplied by the supplier at a nip position of the separating roller and the retard roller and convey the separated sheet toward the downstream side in the conveying direction; and an inclined surface disposed upstream of the nip position in the conveying direction and pivotable between an initial position and a pivoted position about a first pivot axis extending in a direction orthogonal to the conveying direction, the inclined surface including a first end portion and a second end portion which is located downstream of the first end portion in the conveying direction. When the inclined surface is at the initial position: the inclined surface is inclined relative to the conveying direction such that the first end portion and the second end portion are located within the conveyance path and that the second end portion is nearer to the support surface than the first end portion; the first end portion of the inclined surface is located upstream of, in the conveying direction, a downstream end portion of the conveying surface in the conveying direction; and the second end portion of the inclined surface is spaced apart from the conveying surface.

In another aspect of the disclosure, a sheet conveying apparatus includes: a supporter having a support surface configured to support a plurality of sheets; a supplier having a conveying surface exposed from the support surface, the conveying surface being configured to supply one or more sheets supported by the support surface toward a downstream side in a conveying direction along a conveyance path by moving, in the conveying direction, in contact with the one or more sheets supported by the support surface; a separator including a separating roller and a retard roller which are located downstream of the supplier in the conveying direction, the separator being configured to separate one by one the one or more sheets supplied by the supplier at a nip position of the separating roller and the retard roller and convey the separated sheet toward the downstream side in the conveying direction; and an inclined surface disposed upstream of the nip position in the conveying direction and pivotable between an initial position and a pivoted position about a first pivot axis extending in a direction orthogonal to the conveying direction, the inclined surface including a first end portion and a second end portion which is located downstream of the first end portion in the conveying direction. When the inclined surface is at the initial position: the inclined surface is inclined relative to the conveying direction such that the first end portion and the second end portion are located within the conveyance path and that the second end portion is nearer to the support surface than the first end portion; the inclined surface and the conveying surface are spaced apart from each other; and the first pivot axis and the first end portion are located between (i) a first imaginary plane orthogonal to the support surface and extending through an upstream end portion of the conveying surface in the conveying direction and (ii) a second imaginary plane orthogonal to the support surface and extending through a downstream end portion of the conveying surface in the conveying direction.

In still another aspect of the disclosure, a sheet conveying apparatus includes: a supporter having a support surface configured to support a plurality of sheets; a supplier having a conveying surface exposed from the support surface, the conveying surface being configured to supply one or more sheets supported by the support surface toward a downstream side in a conveying direction along a conveyance path by moving, in the conveying direction, in contact with the one or more sheets supported by the support surface; a separator disposed downstream of the supplier in the conveying direction and configured to separate one by one the one or more sheets supplied by the supplier and convey the separated sheet toward the downstream side in the conveying direction; a stopper disposed upstream of the separator in the conveying direction and having a distal end pivotable, about a pivot axis extending in an orthogonal direction which is orthogonal to the conveying direction, between a first position and a second positon relative to the support surface; and an inclined surface disposed upstream of the separator in the conveying direction and offset from the stopper in the orthogonal direction, the inclined surface being pivotable, about a pivot axis extending in the orthogonal direction, between an initial position and a pivoted position relative to the conveying surface. When the stopper is at the first position, the distal end of the stopper extends to the support surface and intersects the conveyance path and an upstream end of the distal end is located upstream of the inclined surface in the conveying direction, and when the stopper is at the second position, the distal end is separated from the support surface and located more downstream in the conveying direction than when the stopper is at the first position. The inclined surface, when at the initial position, is inclined relative to the conveying direction and intersects the conveyance path, and the inclined surface, when at the pivoted position, is farther from the conveying surface than when at the initial position.

BRIEF DESCRIPTION OF THE DRAWINGS

The objects, features, advantages, and technical and industrial significance of the present disclosure will be better understood by reading the following detailed description of the embodiment, when considered in connection with the accompanying drawings, in which.

DETAILED DESCRIPTION OF THE EMBODIMENT

Hereinafter, there will be described one embodiment by reference to the drawings.

Figure 1:
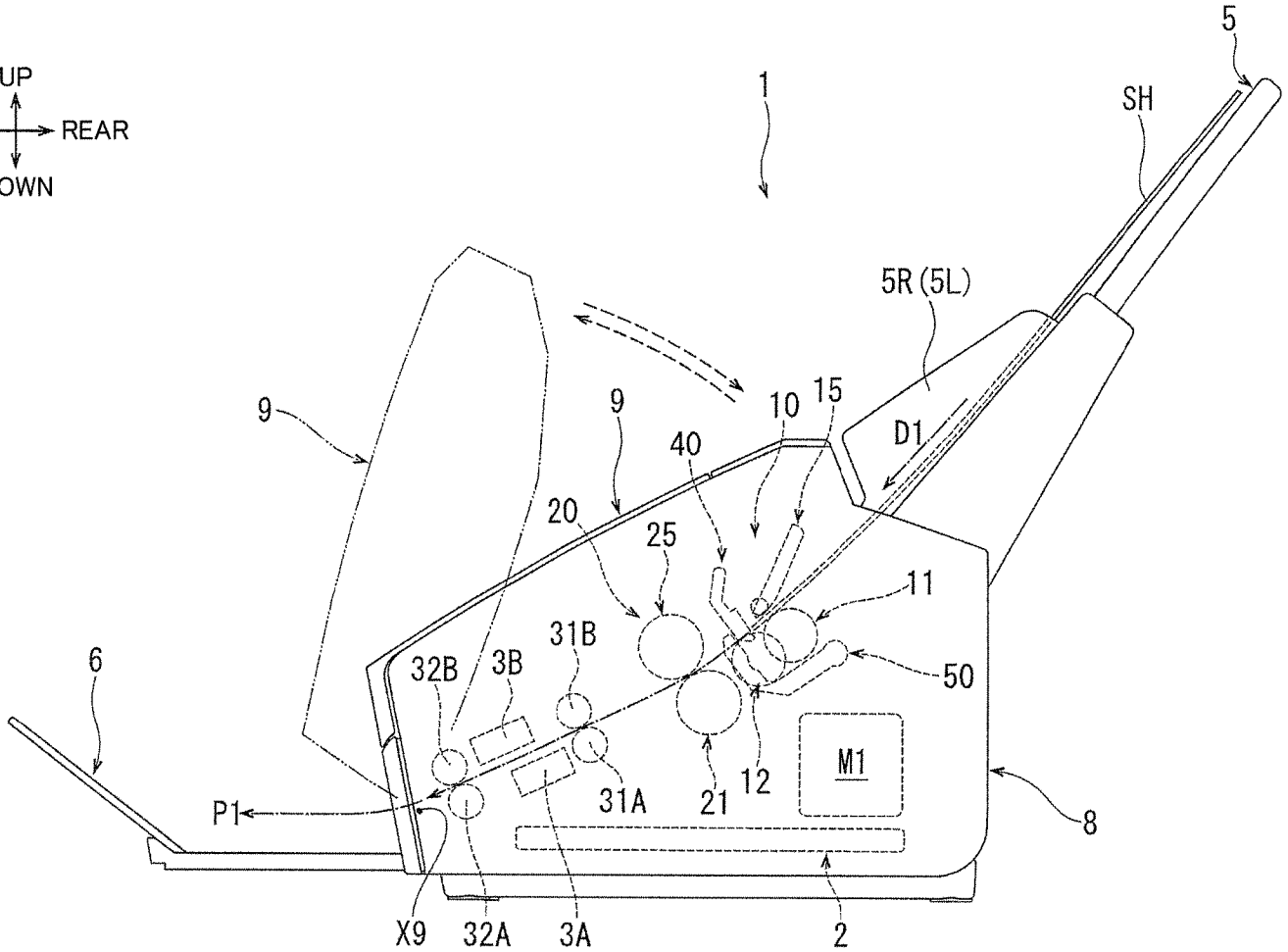
FIG. 1 is a schematic side view of an image reading apparatus according to one embodiment.

As illustrated in FIG. 1, an image reading apparatus 1 is one example of a sheet conveying apparatus. In FIG. 1, a side of the image reading apparatus 1 on which an output tray 6 is disposed is defined as a front side of the image reading apparatus 1. A left side of the image reading apparatus 1 when viewed by a user opposed to the output tray 6 is defined as a left side of the image reading apparatus 1. That is, a back side of the sheet illustrating FIG. 1 is defined as the left side of the image reading apparatus 1. The sides and directions in FIGS. 2-13 are defined with respect to the sides and directions in FIG. 1. There will be described components and devices of the image reading apparatus 1 with reference to the drawings.

Overall Construction

Figure 2:
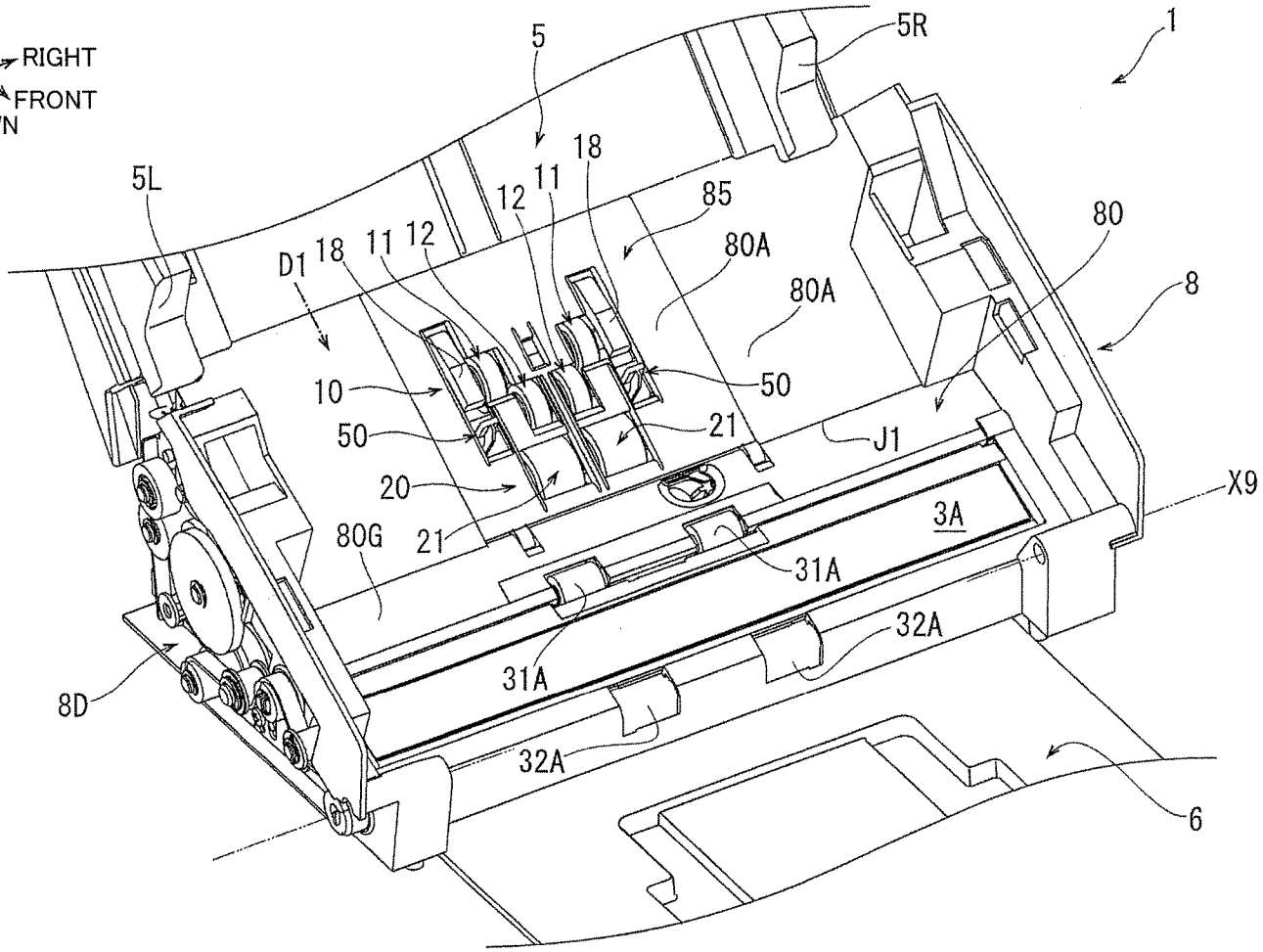
FIG. 2 is a perspective view of a first housing.
Figure 3:
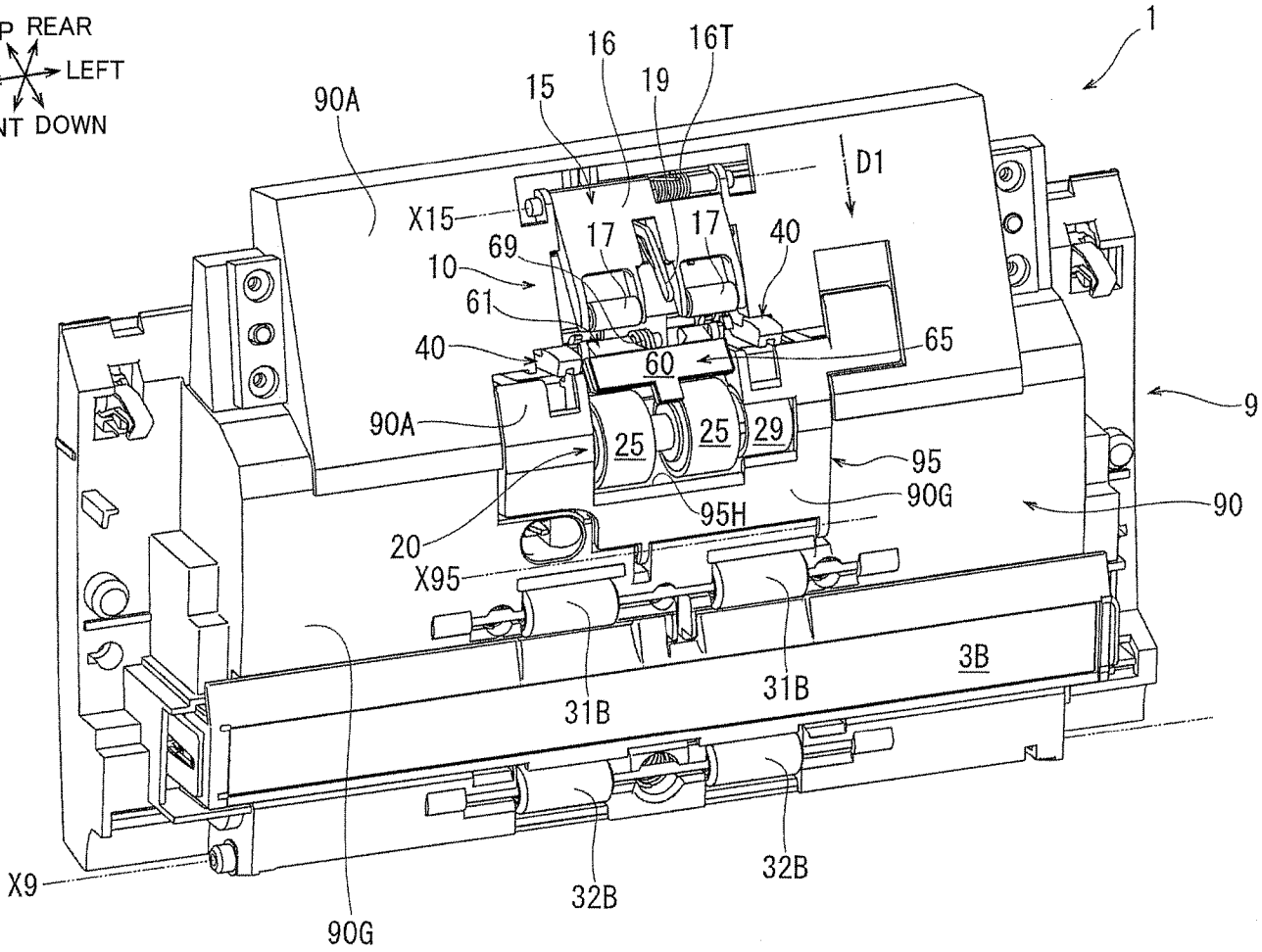
FIG. 3 is a perspective view of a second housing.

As illustrated in FIGS. 1-3, the image reading apparatus 1 includes a first housing 8, a second housing 9, a supply tray 5, and the output tray 6. The second housing 9 is disposed over the first housing 8. The second housing 9 is coupled at its front end portion to the first housing 8 so as to be pivotable about an open/close axis X9 extending in the right and left direction through a front end portion of the first housing 8. In the present embodiment, the right and left direction is orthogonal to a direction in which a sheet is conveyed (hereinafter may be referred to as "conveying direction"). The right and left direction corresponds to the widthwise direction of the supply tray 5.

Figure 4:
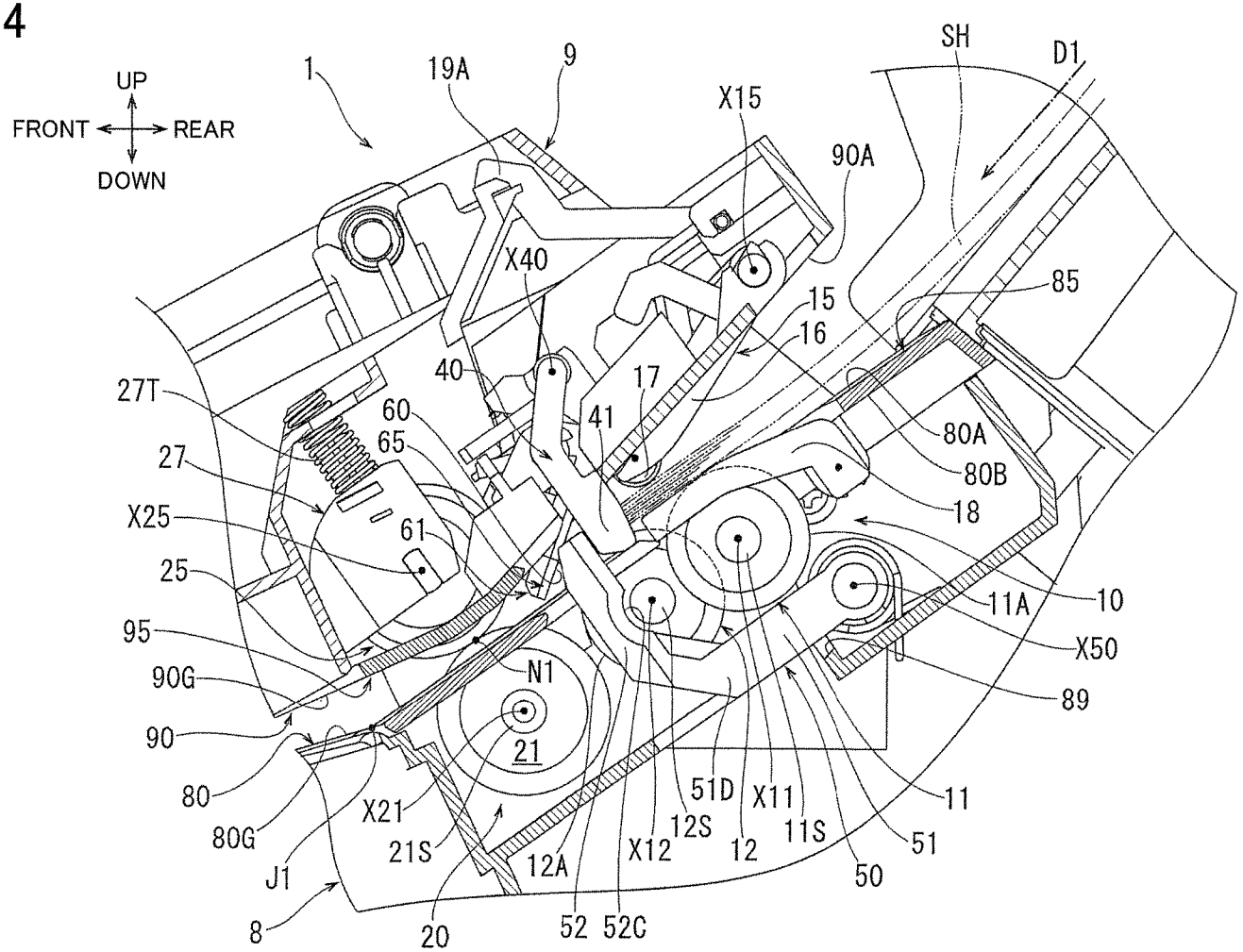
FIG. 4 is a partial cross-sectional view of components including a supplier, a separator, an inclined surface, a pressing member, and stoppers.

As illustrated in FIGS. 2 and 4, an upper surface of the first housing 8 is constituted by an upper surface of a lower chute 80. The upper surface of the first housing 8 is inclined so as to be lower at its rear end portion than at its front end portion. The upper surface of the first housing 8 is divided into a front portion and a rear portion by a reference line J1 that is set at a substantially intermediate portion of the upper surface in the front and rear direction. The angle of inclination of the front portion of the upper surface of the first housing 8 is less than the angle of inclination of the rear portion of the upper surface of the first housing 8. A support surface 80A is formed on the rear portion of the upper surface of the first housing 8. A lower conveying surface 80G is formed on the front portion of the upper surface of the first housing 8. While a seam between the components is used to define the reference line in the present embodiment, the present disclosure is not limited to this configuration. For example, a component or a position at which the inclination angle changes may be used as the reference line.

Figure 6:
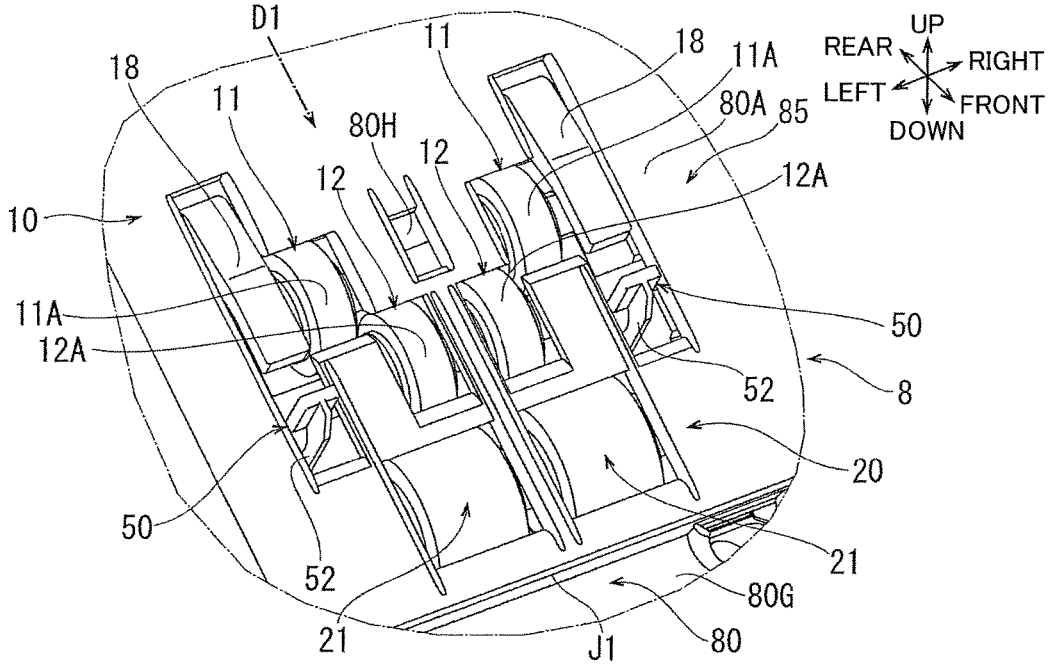
FIG. 6 is a partial perspective view of components including a support surface, first and second supply rollers, and separating rollers.

The lower chute 80 is one example of a supporter. As illustrated in FIGS. 2, 4, and 6, the lower chute 80 is installed with a lower cover 85 that is opened and closed in maintenance, for example. The lower cover 85 is disposed on the rear portion of the upper surface of the first housing 8 at a central portion of the first housing 8 in the right and left direction. An upper surface of the lower cover 85 also forms a portion of the support surface 80A with the upper surface of the lower chute 80.

As illustrated in FIGS. 3 and 4, a lower surface of the second housing 9 is constituted by a lower surface of an upper chute 90. The lower surface of the second housing 9 is inclined so as to be lower at its rear end portion than at its front end portion. A guide surface 90A is formed on the lower surface of the second housing 9 at an area opposed to the support surface 80A of the first housing 8. An upper conveying surface 90G is formed on the lower surface of the second housing 9 at an area opposed to the lower conveying surface 80G of the first housing 8. The angle of inclination of the upper conveying surface 90G is less than the angle of inclination of the guide surface 90A. As illustrated in FIG. 4, the guide surface 90A extending from a rear end portion of the second housing 9 is inclined so as to be nearer to the support surface 80A of the first housing 8 at a front portion of the guide surface 90A than at a rear portion thereof. That is, a distance between the support surface 80A and the front portion of the guide surface 90A is less than a distance between the support surface 80A and the rear portion of the guide surface 90A.

Figure 7:
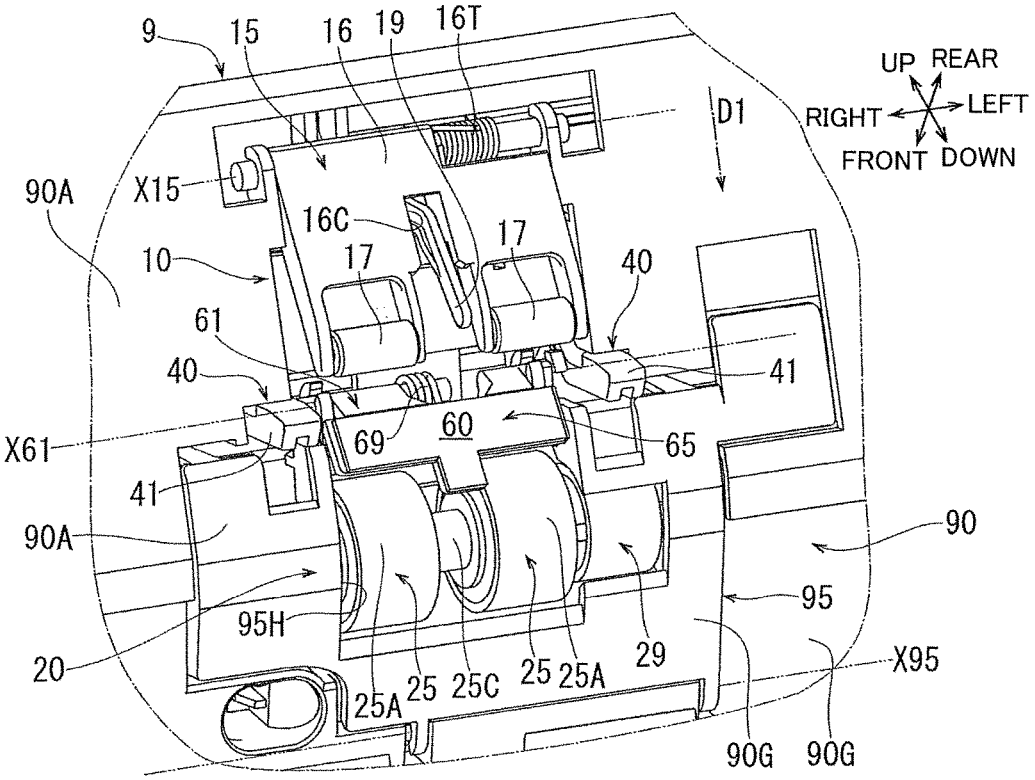
FIG. 7 is a partial perspective view of components including a chute, a cover being in a closed state, retard rollers, the inclined surface, the pressing member, and the stoppers.
Figure 8:
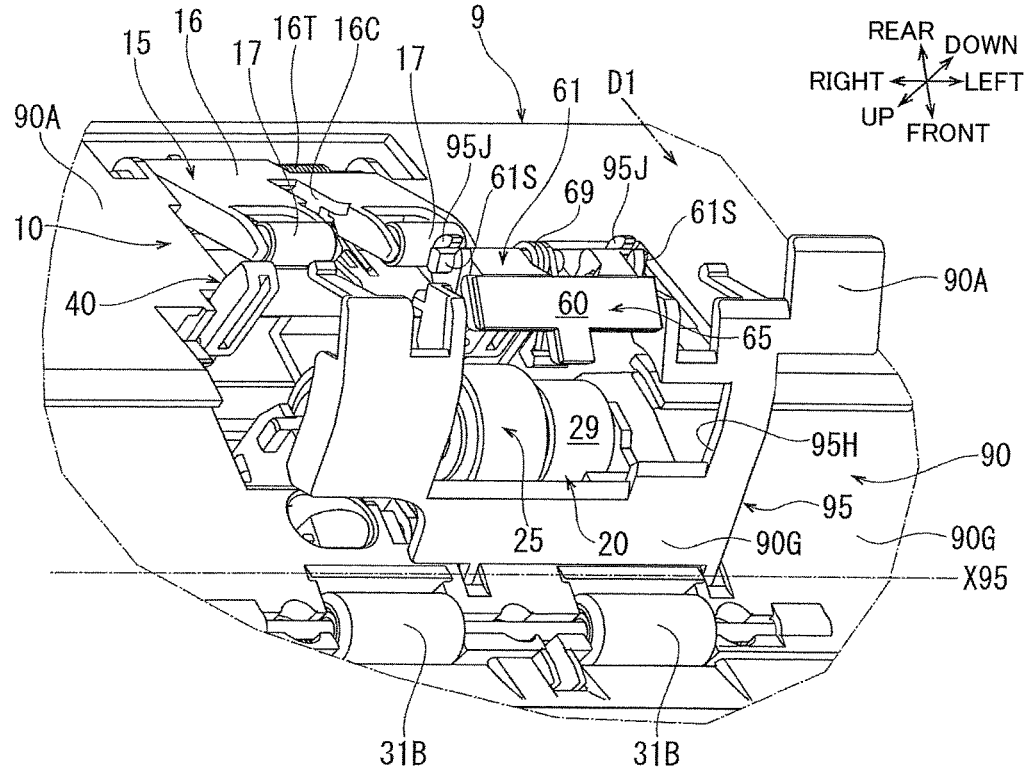
FIG. 8 is a partial perspective view of the components including the chute, the cover being in an open state, the retard rollers, the inclined surface, the pressing member, and the stoppers.

The upper chute 90 is one example of a chute. As illustrated in FIGS. 3, 4, and 7, the upper chute 90 is installed with a cover 95. The cover 95 is disposed on an intermediate portion of the lower surface of the second housing 9 in the front and rear direction at a central portion of the second housing 9 in the right and left direction. Like the lower surface of the upper chute 90, the angle of inclination of a front portion of a lower surface of the cover 95 is less than the angle of inclination of a rear portion of the lower surface of the cover 95. The rear portion of the lower surface of the cover 95 forms a portion of the guide surface 90A with a portion of the lower surface of the upper chute 90. The front portion of the lower surface of the cover 95 forms a portion of the upper conveying surface 90G with a portion of the lower surface of the upper chute 90. The cover 95 is coupled at its front end portion to the upper chute 90 so as to be pivotable about an open/close axis X95 extending in the right and left direction. As illustrated in FIG. 8, the cover 95 is made open in maintenance, for example.

As illustrated in FIG. 2, the supply tray 5 is connected to a rear end portion of the first housing 8 and inclined so as to be higher at a rear portion of the supply tray 5 than at a front portion thereof. Edge guides (width limiting guides) 5L, 5R are provided on an upper surface of the supply tray 5 so as to be slidable in the right and left direction. The edge guides 5L, 5R are movable toward and away from each other in the right and left direction with respect to the center of the supply tray 5. With this construction, various sizes of sheets SH placed on the supply tray 5 may be positioned in the right and left direction by the edge guides 5L, 5R. The sizes of the sheets SH placeable on the supply tray 5 range from a business-card size to the A4 size, for example.

As illustrated in FIGS. 1 and 2, the output tray 6 extends frontward from a position located below the lower conveying surface 80G formed on the front end portion of the first housing 8.

As illustrated in FIG. 1, a conveyance path P1 is defined between the upper surface of the first housing 8 and the lower surface of the second housing 9. The support surface 80A and the lower conveying surface 80G of the first housing 8 illustrated in FIG. 2 define the conveyance path P1 from below. The guide surface 90A and the upper conveying surface 90G of the second housing 9 illustrated in FIG. 3 define the conveyance path P1 from above. The sheet SH to be conveyed for image reading is supported over the supply tray 5 and the support surface 80A. The sheet SH is conveyed in a conveying direction D1 along the conveyance path P1 and discharged onto the output tray 6. The conveying direction D1 is directed frontward and downward from the upstream supply tray 5 toward the downstream output tray 6.

As indicated by the two-dot chain line in FIG. 1, the second housing 9 is pivotable about the open/close axis X9 so as to move its rear end portion upward and frontward. This pivotal movement moves the second housing 9 off the upper surface of the first housing 8 so as to expose the conveyance path P1.

The image reading apparatus 1 includes a supplier 10, a separator 20, first conveying rollers 31A, first pinch rollers 31B, a first reader 3A, a second reader 3B, second conveying rollers 32A, and second pinch rollers 32B along the conveyance path P1.

Constructions of the supplier 10 and the separator 20 will be described later in detail. As illustrated in FIGS. 3-13, the image reading apparatus 1 further includes a holder 61, a friction member 65, an inclined surface 60, stoppers 40, and stopper cams 50 along the conveyance path P1, and constructions of these components will also be described later in detail.

As illustrated in FIGS. 1 and 4, the supplier 10 includes first supply rollers 11 and second supply rollers 12. The sheets SH supported on the supply tray 5 and the support surface 80A are supplied by these rollers 11, 12 along the conveyance path P1 toward the downstream side in the conveying direction D1. The separator 20 includes two separating rollers 21 and two retard rollers 25. The sheets SH supplied from the supplier 10 are separated one by one and conveyed toward the downstream side in the conveying direction D1.

As illustrated in FIG. 2, the first conveying rollers 31A, the first reader 3A, and the second conveying rollers 32A are provided on the first housing 8.

The first conveying rollers 31A are rotatably supported by the lower chute 80 in a state in which outer circumferential surfaces of the respective first conveying rollers 31A are partly exposed from an intermediate portion of the lower conveying surface 80G in the front and rear direction.

The first reader 3A is assembled to the lower chute 80 at a position located downstream of the first conveying rollers 31A in the conveying direction D1. Examples of the first reader 3A include a contact image sensor (CIS) and a charge coupled device (CCD). The first reader 3A has a reading surface facing upward. This reading surface defines a portion of the conveyance path P1 from below with the lower conveying surface 80G.

The second conveying rollers 32A are rotatably supported by the lower chute 80 in a state in which outer circumferential surfaces of the respective second conveying rollers 32A are partly exposed from a front end portion of the lower conveying surface 80G.

As illustrated in FIG. 3, the first pinch rollers 31B, the second reader 3B, and the second pinch rollers 32B are provided on the second housing 9.

The first pinch rollers 31B are rotatably supported by the upper chute 90 in a state in which outer circumferential surfaces of the first pinch rollers 31B are partly exposed from an intermediate portion of the upper conveying surface 90G in the front and rear direction. The first pinch rollers 31B are pressed against the first conveying rollers 31A respectively by urging springs, not illustrated, so as to be rotated by rotation of the first conveying rollers 31A.

The second reader 3B is assembled to the upper chute 90 at a position located downstream of the first pinch rollers 31B in the conveying direction D1. The second reader 3B employs a sensor similar to the sensor employed for the first reader 3A. The second reader 3B has a reading surface facing downward. This reading surface defines a portion of the conveyance path P1 from above with the upper conveying surface 90G.

The second pinch rollers 32B are rotatably supported by the upper chute 90 in a state in which outer circumferential surfaces of the second pinch rollers 32B are partly exposed from a front end portion of the upper conveying surface 90G. The second pinch rollers 32B are pressed against the second conveying rollers 32A respectively by urging springs, not illustrated, so as to be rotated by rotation of the second conveying rollers 32A.

As illustrated in FIG. 1, the image reading apparatus 1 includes a control board 2 and a motor M1. The control board 2 and the motor M1 are provided in the first housing 8. The control board 2 as a controller is configured to control the motor M1, the first reader 3A, and the second reader 3B in an image reading operation. Also, the control board 2 receives inputs and instructions from a user and displays information relating to operations and settings of the image reading apparatus 1 via, e.g., an input/output panel, not illustrated. As illustrated in FIG. 2, a transmission mechanism 8D is provided in the first housing 8 at a position located on an inner side of a left wall of the first housing 8. The transmission mechanism 8D includes a gear group, pulleys and pulley belts, and a one-way clutch. The transmission mechanism 8D is mounted on a frame, not illustrated, in the first housing 8. When the motor M1 is controlled by the control board 2 and rotated forwardly, a driving force generated by the motor M1 is transmitted to the first supply rollers 11, the second supply rollers 12, the separating rollers 21, the first conveying rollers 31A, and the second conveying rollers 32A via the transmission mechanism 8D to rotate their respective outer circumferential surfaces in directions for conveying the sheet SH in the conveying direction D1.

Each of the sheets SH separated one by one by the separator 20 is conveyed by the first conveying rollers 31A and the first pinch rollers 31B toward the first reader 3A and the second reader 3B. After completion of image reading by the first reader 3A and the second reader 3B, the sheet SH is discharged onto the output tray 6 by the second conveying rollers 32A and the second pinch rollers 32B.

Supplier

As illustrated in FIGS. 2-7, the supplier 10 includes the first supply rollers 11, the second supply rollers 12, a pressing member 15, a sheet sensor 19, and two set guides 18.

Figure 5:
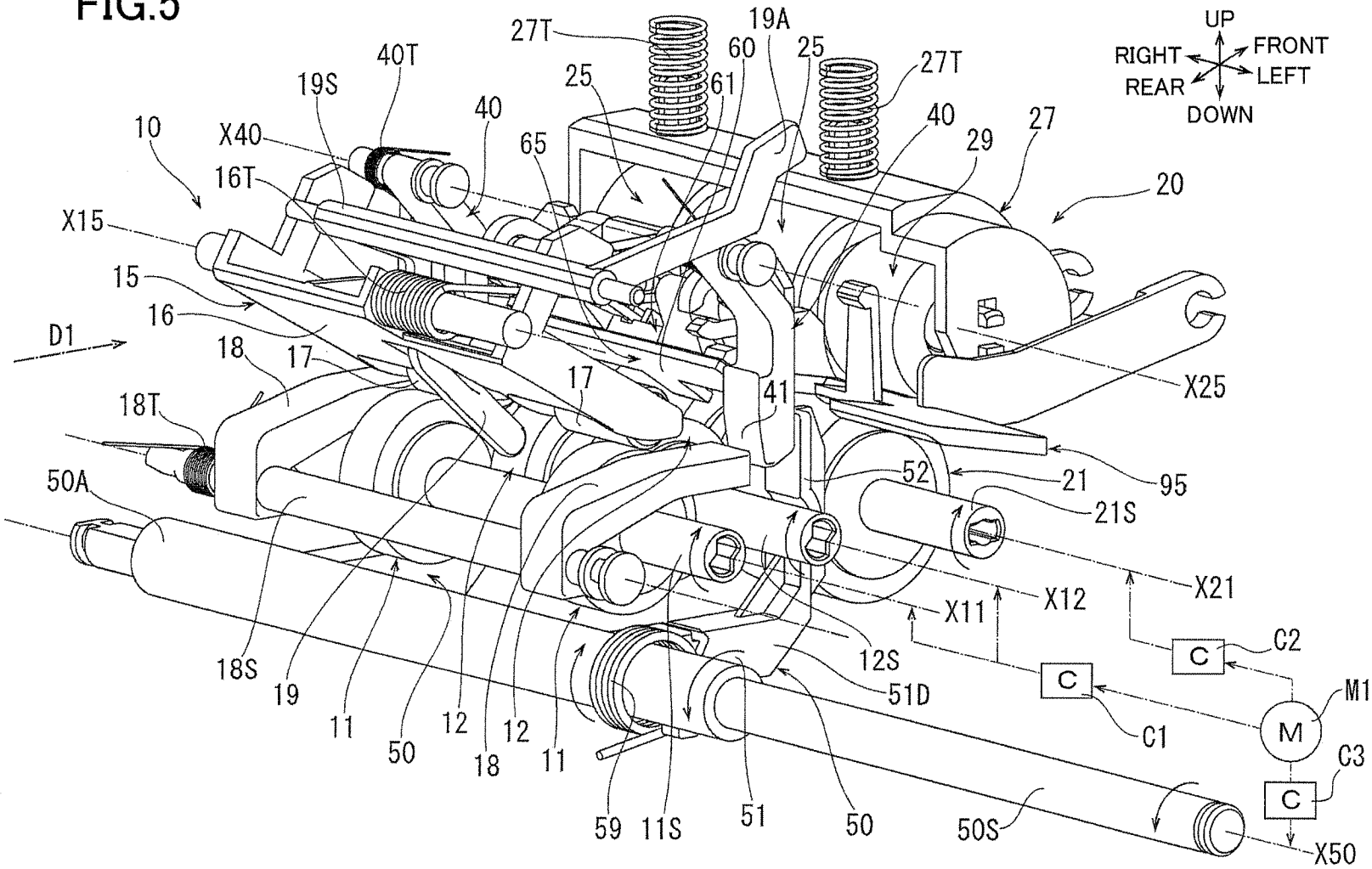
FIG. 5 is a perspective view of components including the supplier, the separator, the inclined surface, the pressing member, and the stoppers.

As illustrated in FIGS. 4-6, the two first supply rollers 11 are spaced apart from each other in the right and left direction. The first supply rollers 11 are fixed to a first rotation shaft 11S so as to be rotatable together with the first rotation shaft 11S. The first rotation shaft 11S defines a first rotation axis X11 extending in the right and left direction. Likewise, the two second supply rollers 12 are spaced apart from each other in the right and left direction. The second supply rollers 12 are fixed to a second rotation shaft 12S so as to be rotatable together with the second rotation shaft 12S. The second rotation shaft 12S defines a second rotation axis X12 extending in the right and left direction. The second supply rollers 12 are disposed downstream of the first supply rollers 11 in the conveying direction D1.

The first supply rollers 11 are arranged in a row in the right and left direction in which the first rotation shaft 11S extends. The second supply rollers 12 are arranged in a row in the right and left direction in which the second rotation shaft 12S extends. The row of the first supply rollers 11 and the row of the second supply rollers 12 are different from each other in position in the conveying direction D1. The two first supply rollers 11 are provided on opposite sides of the two second supply rollers 12 in the right and left direction.

As illustrated in FIG. 4, an opposite surface of the lower chute 80 from the support surface 80A is a back surface 80B. The first rotation axis X11 and the second rotation axis X12 are located below a portion of the back surface 80B.

Figure 13:
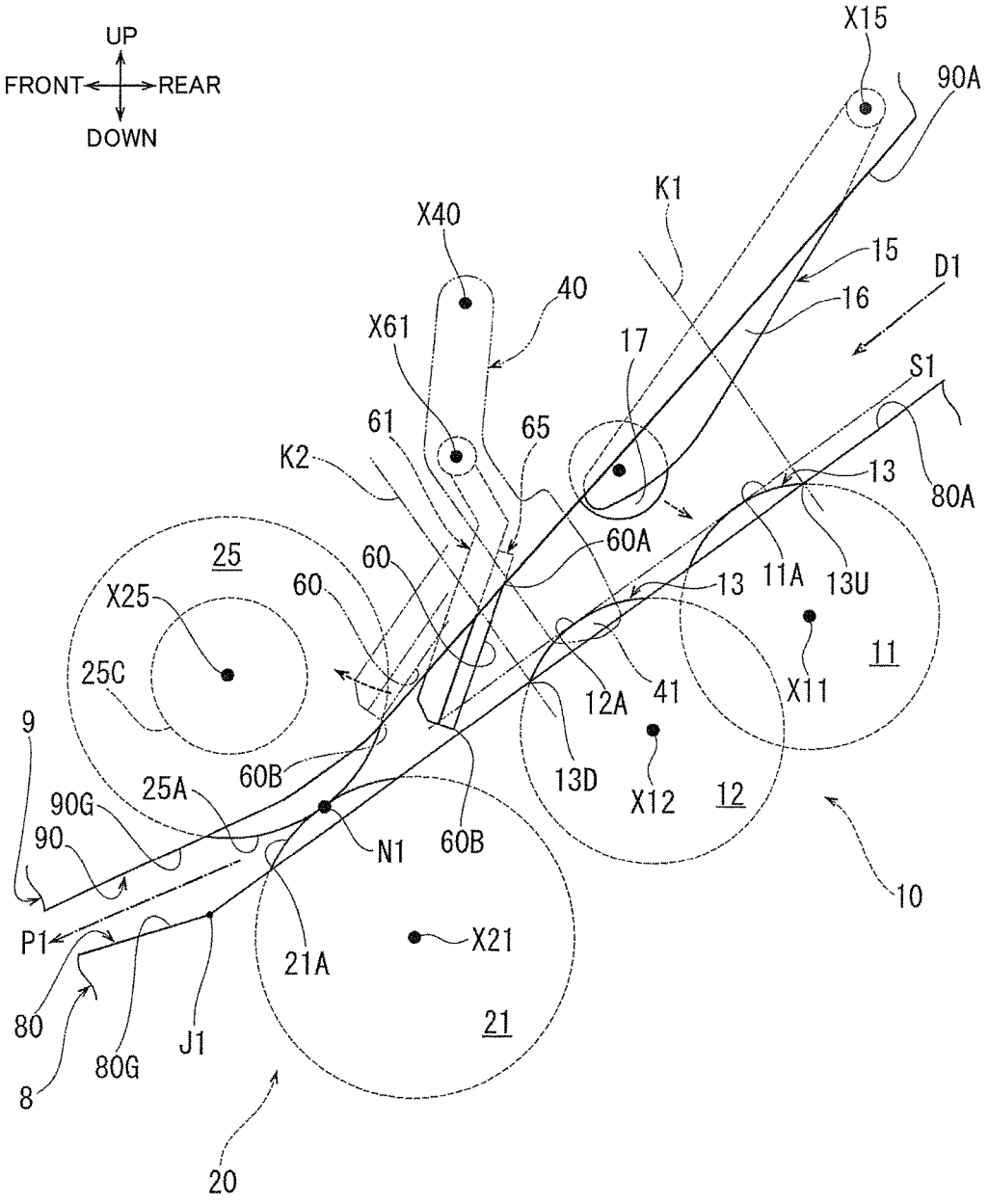
FIG. 13 is a schematic view for explaining a relative positional relationship among components including the supplier, the separator, the inclined surface, the pressing member, and the stoppers.

As illustrated in FIG. 13, each of the first supply rollers 11 has a first cylindrical surface 11A. A portion of the first cylindrical surface 11A is exposed from the support surface 80A. Each of the second supply rollers 12 has a second cylindrical surface 12A. A portion of the second cylindrical surfaces 12A is exposed from the support surface 80A.

The portions of the first cylindrical surfaces 11A which are exposed from the support surface 80A and the portions of the second cylindrical surfaces 12A which are exposed from the support surface 80A constitute a conveying surface 13 for conveying the sheet SH. A downstream end portion 13D of the conveying surface 13 in the conveying direction D1 is an end portion of the portion of each second cylindrical surface 12A which is exposed from the support surface 80A. This downstream end portion 13D is located on the most downstream side in the exposed portion of each second cylindrical surface 12A in the conveying direction D1. An upstream end portion 13U of the conveying surface 13 in the conveying direction D1 is an end portion of the portion of each first cylindrical surface 11A which is exposed from the support surface 80A. This upstream end portion 13U is located on the most upstream side in the exposed portion of each first cylindrical surface 11A in the conveying direction D1.

The first cylindrical surfaces 11A and the second cylindrical surfaces 12A partly overlap each other when viewed in the right and left direction in which the first rotation axis X11 and the second rotation axis X12 extend. In other words, as illustrated in FIG. 13, the first rotation axis X11 and the second rotation axis X12 are disposed such that a distance between the first rotation axis X11 and the second rotation axis X12 in the conveying direction D1 is less than the sum of the radius of the first supply roller 11 and the radius of the second supply roller 12. This construction reduces the size of a hollow between the portion of each of the first cylindrical surfaces 11A which is exposed from the support surface 80A and the portion of the corresponding second cylindrical surface 12A which is exposed from the support surface 80A, i.e., a hollow formed on the conveying surface 13.

As illustrated in, e.g., FIGS. 4, 5, and 7, the pressing member 15 includes an arm 16 and two rotation members 17. The arm 16 is coupled to the upper chute 90 so as to be pivotable about a second pivot axis X15. The second pivot axis X15 extends in the right and left direction through a rear end portion of the guide surface 90A of the second housing 9. That is, the second pivot axis X15 is located upstream of the first supply rollers 11 in the conveying direction D1.

The arm 16 is opposed to the support surface 80A and inclined so as to be lower at a front portion of the arm 16 than at a rear portion thereof. A downstream end portion of the arm 16 in the conveying direction D1 is opposed to portions of the first cylindrical surfaces 11A which are exposed from the support surface 80A. The two rotation members 17 are spaced apart from each other in the right and left direction and rotatably supported by the downstream end portion of the arm 16 in the conveying direction D1.

As illustrated in FIGS. 5 and 13, the rotation members 17 are respectively opposed to the first cylindrical surfaces 11A of the respective first supply rollers 11. The arm 16 is urged by a torsion coil spring 16T illustrated in FIG. 5 so as to pivot in a direction in which the rotation members 17 are moved toward the first cylindrical surfaces 11A. As illustrated in FIG. 4, this construction enables the rotation members 17 to contact an uppermost one of the sheets SH supported on the support surface 80A to press the sheets SH onto the first supply rollers 11.

As illustrated in FIG. 7, the arm 16 has a cutout 16C formed between the rotation members 17. The arm 16 is recessed toward the second pivot axis X15 by the cutout 16C. The sheet sensor 19 protrudes downward from the second housing 9 through the cutout 16C formed in the arm 16. As illustrated in FIG. 5, an upper end portion of the sheet sensor 19 is connected to a pivot shaft 19S pivotably supported in the second housing 9. A shutter 19A is connected to the pivot shaft 19S.

As illustrated in FIG. 6, the support surface 80A has a recess 80H formed between the first supply rollers 11. Though not illustrated, a distal end portion of the sheet sensor 19 is located in the recess 80H in a state in which no sheet SH is supported on the support surface 80A. In a state in which the sheet or sheets SH are supported on the support surface 80A, in contrast, the distal end portion of the sheet sensor 19 is pushed up by the sheets SH and spaced apart from the recess 80H. The shutter 19A exposes or intercepts a path of light emitted by a photo interrupter, not illustrated, in accordance with the movement of the sheet sensor 19, and a detection signal output from the photo interrupter, not illustrated, is transmitted to the control board 2. The control board 2 determines based on the detection signal whether the sheet or sheets SH are supported on the support surface 80A.

As illustrated in FIGS. 4-6, the two set guides 18 are spaced apart from each other in the right and left direction. The set guides 18 are adjacent to the respective first supply rollers 11. The left set guide 18 is disposed to the left of the left first supply roller 11. The right set guide 18 is disposed to the right of the right first supply roller 11.

As illustrated in FIG. 5, the left set guide 18 is connected to a left end portion of a pivot shaft 18S pivotably supported by the frame, not illustrated, in the first housing 8. The right set guide 18 is connected to a right end portion of the pivot shaft 18S. As illustrated in FIGS. 4 and 6, each of the right and left set guides 18 extends toward the downstream side in the conveying direction D1, and upper surfaces of the right and left set guides 18 are exposed from the support surface 80A. The right and left set guides 18 are urged by a torsion coil spring 18T illustrated in FIG. 5 such that their respective upper surfaces exposed from the support surface 80A are situated above the support surface 80A.

As illustrated in FIG. 4, a leading edge of each sheet SH supported by the support surface 80A is guided by the arm 16 of the pressing member 15 and the set guides 18 so as to pass through the first supply rollers 11 without being caught by the first supply rollers 11 and then nipped by the first supply rollers 11 and the rotation members 17 of the pressing member 15.

Figure 12:
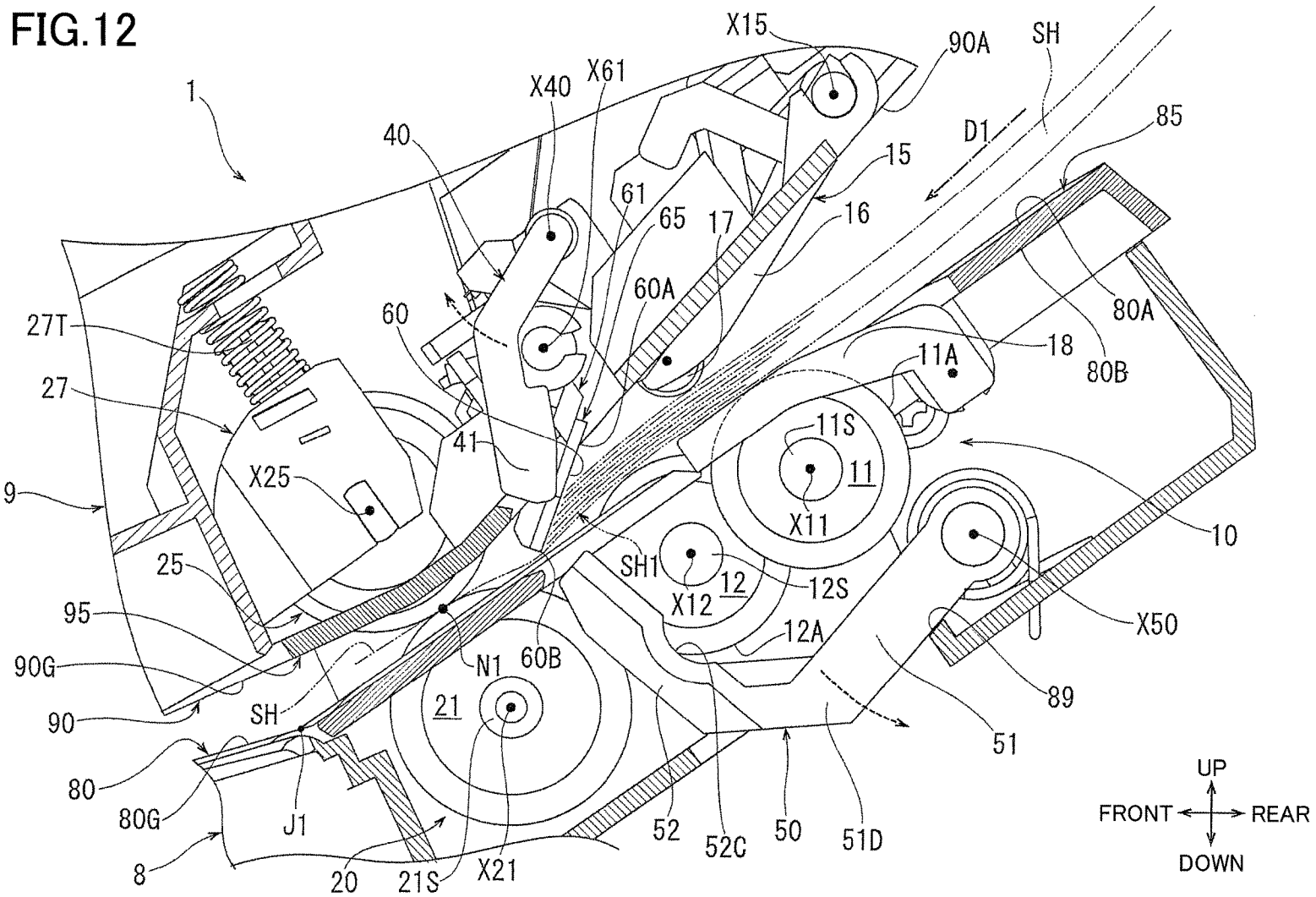
FIG. 12 is a partial cross-sectional view of components including the supplier, the separator, the inclined surface, the pressing member, and the stoppers.

As illustrated in FIG. 5, forward rotation of the motor M1 establishes a connected state of a one-way clutch C1, so that the driving force is transmitted to the first rotation shaft 11S and the second rotation shaft 12S. This transmission causes the first supply rollers 11 to be rotated about the first rotation axis X11 in a direction in which the sheet SH is to be conveyed in the conveying direction D1. Also, the second supply rollers 12 are rotated about the second rotation axis X12 in the direction in which the sheet SH is to be conveyed in the conveying direction D1. As a result, as illustrated in FIG. 12, the sheet SH supported on the support surface 80A is supplied by the supplier 10 along the conveyance path P1 toward the downstream side in the conveying direction D1.

It is noted that when the motor M1 is rotated reversely, the one-way clutch C1 illustrated in FIG. 5 is in a disconnected state, so that no driving force is transmitted to the first rotation shaft 11S and the second rotation shaft 12S.

Separator

As illustrated in FIGS. 2-7, the separator 20 includes the two separating rollers 21 and the retard rollers 25. The separating rollers 21 and the retard rollers 25 are located downstream of the supplier 10 in the conveying direction D1. As illustrated in FIG. 4, the separating rollers 21 and the retard rollers 25 are disposed upstream of, in the conveying direction D1, the reference line J1 as a boundary between the support surface 80A and the lower conveying surface 80G. In other words, the support surface 80A extends to a position located downstream of the separator 20 in the conveying direction D1 and defines a portion of the conveyance path P1 from below.

The two separating rollers 21 are spaced apart from each other in the right and left direction. The separating rollers 21 are fixed to a third rotation shaft 21S illustrated in FIGS. 4 and 5 so as to be rotatable together with the third rotation shaft 21S. The third rotation shaft 21S defines a third rotation axis X21 extending in the right and left direction.

As illustrated in FIG. 4, the third rotation axis X21 is located below a portion of the back surface 80B of the lower chute 80. As illustrated in FIG. 13, each of the separating rollers 21 has a third cylindrical surface 21A. A portion of the third cylindrical surface 21A is exposed from the support surface 80A.

As illustrated in FIGS. 4, 5, and 7, the two retard rollers 25 are spaced apart from each other in the right and left direction. The retard rollers 25 are held by a retard-roller holder 27 so as to be rotatable about a fourth rotation axis X25. A torque limiter 29 is provided between the retard-roller holder 27 and the retard rollers 25. As illustrated in FIG. 4, the fourth rotation axis X25 extends over the support surface 80A in the right and left direction.

As illustrated in FIG. 7, a small-diameter portion 25C is provided between an outer circumferential surface 25A of the left retard roller 25 and an outer circumferential surface 25A of the right retard roller 25. The small-diameter portion 25C is recessed toward the fourth rotation axis X25 to define a space as a recessed portion between the left retard roller 25 and the right retard roller 25. It is noted that the outer circumferential surfaces 25A adjacent to each other and the recessed small-diameter portion 25C located between the outer circumferential surfaces 25A may be formed on an outer circumferential surface of one retard roller 25.

A portion of each of the outer circumferential surfaces 25A is exposed from an opening 95H formed in the cover 95 constituting a portion of the guide surface 90A.

As illustrated in FIGS. 4 and 5, the retard rollers 25 are pressed toward the respective separating rollers 21 by a compression coil spring 27T mounted on an upper surface of the retard-roller holder 27. As illustrated in FIG. 12, the sheet SH supplied by the supplier 10 is nipped by the separating rollers 21 and the retard rollers 25 at a nip position N1.

As illustrated in FIG. 5, the forward rotation of the motor M1 establishes a connected state of a one-way clutch C2, so that the driving force is transmitted to the third rotation shaft 21S. This transmission causes the separating rollers 21 to be rotated about the third rotation axis X21 in the direction in which the sheet SH is to be conveyed in the conveying direction D1.

The torque limiter 29 stops rotation of the retard rollers 25 when torque acting on the retard rollers 25 pressed against the separating rollers 21 is less than or equal to a particular value. The torque limiter 29 allows rotation of the retard rollers 25 when the torque is greater than the particular value. Thus, in the case where a single sheet SH is supplied, the torque limiter 29 allows rotation of the retard rollers 25, so that the retard rollers 25 are rotated by rotation of the separating rollers 21 to convey the sheet SH in the conveying direction D1. In the case where two or more sheets SH are supplied, the torque limiter 29 stops rotation of the retard rollers 25, so that a separating force in a direction reverse to the conveying direction D1 is applied to the sheets SH other than the sheet SH contacting the separating rollers 21.

It is noted that in the case where the motor M1 is rotated reversely, the one-way clutch C2 is in a disconnected state, so that no driving force is transmitted to the third rotation shaft 21S.

Holder, Friction Member, and Inclined Surface

As illustrated in, e.g., FIG. 7, the holder 61, the friction member 65, and the inclined surface 60 are mounted on the cover 95 that is coupled to the upper chute 90 of the second housing 9 so as to be openable and closable. As illustrated in FIG. 13, the holder 61, the friction member 65, and the inclined surface 60 are provided upstream of the nip position N1 and downstream of the first supply rollers 11 and the rotation members 17 of the pressing member 15 in the conveying direction D1.

Figure 10:
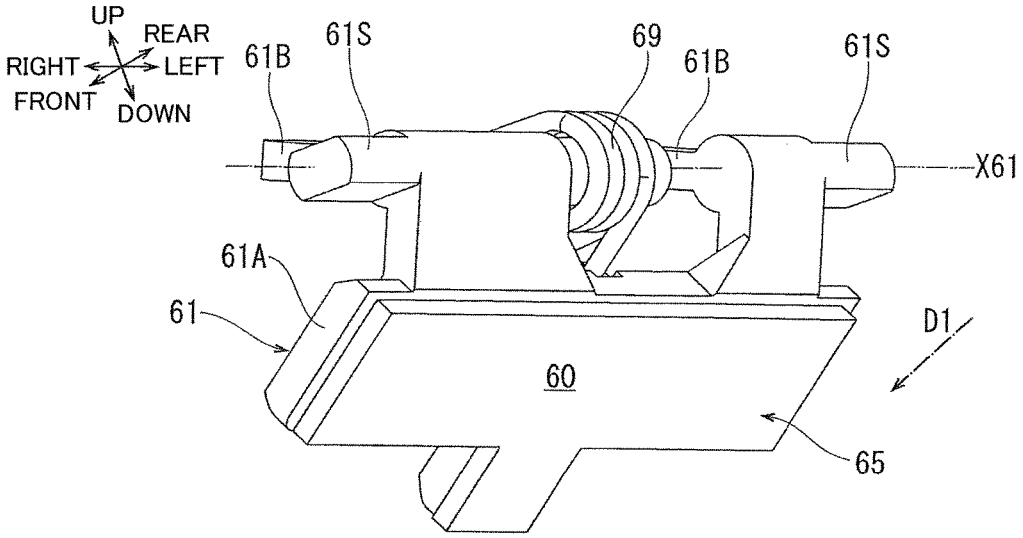
FIG. 10 is a perspective view of the holder provided with the friction member having the inclined surface.
Figure 11:
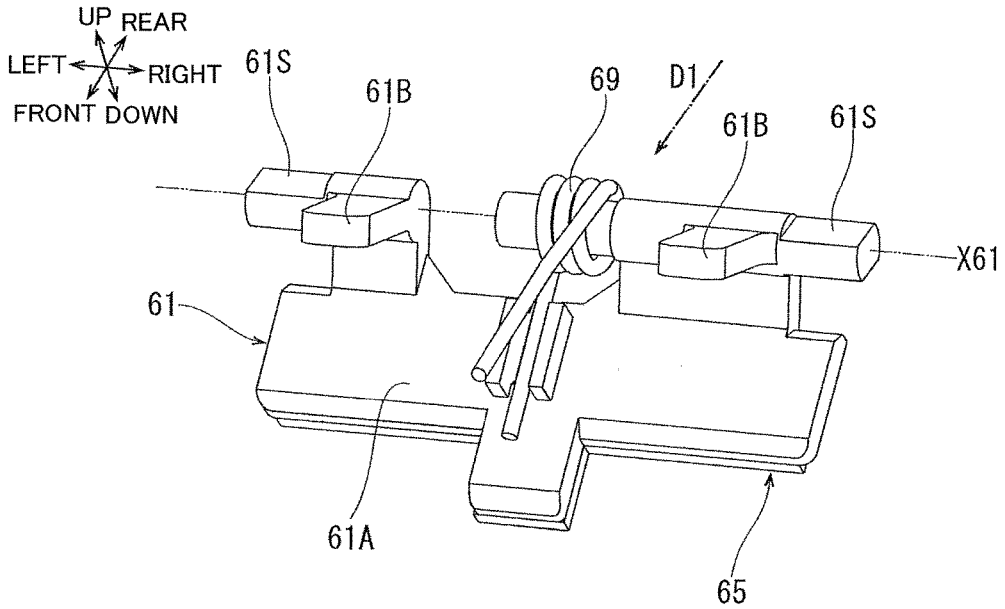
FIG. 11 is a perspective view of the holder provided with the friction member having the inclined surface.

As illustrated in FIGS. 10 and 11, the holder 61 includes a base plate 61A, a pivot shaft 61S, and positioning protrusions 61B. The base plate 61A is a flat plate having a substantially T-shape. The pivot shaft 61S is connected to an upper end portion of the base plate 61A. The pivot shaft 61S defines a first pivot axis X61 extending in the right and left direction. An intermediate portion of the pivot shaft 61S in the right and left direction is cut out. An urging member 69 in the form of a torsion coil spring is mountable on the pivot shaft 61S via the cutout portion. The positioning protrusions 61B protrude from positions respectively located to the right and left of a portion of the pivot shaft 61S at which the urging member 69 is mounted and which is a substantially center of the two positions in the right and left direction. Each of the positioning protrusions 61B is a small piece protruding outward in a radial direction of the first pivot axis X61 (the pivot shaft 61S). Specifically, the positioning protrusions 61B protrude from the pivot shaft 61S in the front direction, i.e., in the downstream direction in the conveying direction D1.

The friction member 65 is formed of a material such as rubber and an elastomer. Like the base plate 61A, the friction member 65 is a flat plate having a substantially T-shape. A bonding material, such as a double-sided tape, is used to stick the friction member 65 to a surface of the base plate 61A which faces downward. The inclined surface 60 is constituted by a surface of the friction member 65 which faces downward.

Figure 9:
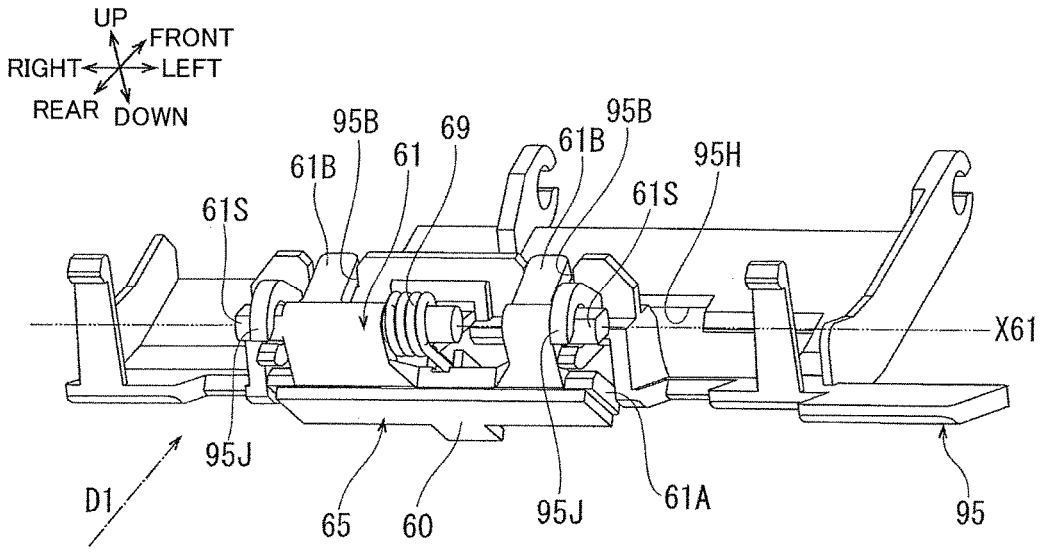
FIG. 9 is a perspective view of (i) a holder provided with a friction member having an inclined surface and (ii) a cover configured to support the holder pivotably.

As illustrated in FIGS. 8 and 9, a pair of shaft supporters 95J are formed on peripheral portions of the cover 95 which are respectively located to the right and left of the opening 95H. The shaft supporters 95J are provided at an end portion of the cover 95 which is located on an opposite side of the cover 95 from the open/close axis X95. Right and left end portions of the pivot shaft 61S are respectively supported by the shaft supporters 95J, whereby the holder 61 is mounted on the cover 95 so as to be pivotable about the first pivot axis X61. As illustrated in FIG. 13, the first pivot axis X61 extends over the support surface 80A in the right and left direction. In other words, the first pivot axis X61 is located opposite to the first rotation axis X11, the second rotation axis X12, and the third rotation axis X21 relative to the support surface 80A. The urging member 69 urges the holder 61 downward so as to move the inclined surface 60 toward the second cylindrical surfaces 12A of the second supply rollers 12.

As illustrated in FIG. 9, two positioning recesses 95B each as one example of a limiter are formed between the right and left shaft supporters 95J of the cover 95. The positioning protrusions 61B of the holder 61 urged by the urging member 69 are stopped by contacting the respective positioning recesses 95B in a state in which the inclined surface 60 is not in contact with the sheet SH to be supplied, whereby the inclined surface 60 is kept at an initial position illustrated in FIGS. 4 and 13. When the inclined surface 60 is pushed toward the downstream side in the conveying direction D1 by the sheet SH being supplied, the inclined surface 60 pivots from the initial position about the first pivot axis X61 as indicated by, e.g., the two-dot chain line in FIG. 13.

Here, there will be explained the inclined surface 60 in detail with reference to FIG. 13. The inclined surface 60 includes: a first end portion 60A as an upstream portion in the conveying direction D1; and a second end portion 60B as a downstream portion in the conveying direction D1. Here, the first end portion 60A is not an upper end of a surface of the friction member 65. The first end portion 60A is an upper end portion of a portion of a surface of the friction member 65, which portion is exposed from the guide surface 90A in a state in which the inclined surface is located at the initial position with no sheets SH set on the support surface 80A. The second end portion 60B is a lower end portion of the surface of the friction member 65.

The inclined surface 60, located at the initial position, is inclined downward from the first end portion 60A toward the second end portion 60B. That is, the second end portion 60B is nearer to the support surface 80A than the first end portion 60A. The first end portion 60A of the inclined surface 60 is located upstream of the downstream end portion 13D of the conveying surface 13 in the conveying direction D1.

The second end portion 60B of the inclined surface 60 is located downstream of the downstream end portion 13D of the conveying surface 13 in the conveying direction D1. The second end portion 60B of the inclined surface 60, located at the initial position, intersects a tangent S1 touching the conveying surface 13 and extending parallel with the support surface 80A, and extends toward the support surface 80A. It is noted that the second end portion 60B of the inclined surface 60 is not in contact with the support surface 80A.

The entire inclined surface 60 including the second end portion 60B is spaced apart from the conveying surface 13 in the state in which the inclined surface 60 is located at the initial position. When the inclined surface 60 pivots from the initial position, the inclined surface 60 is further spaced apart from the conveying surface 13.

The first pivot axis X61 is located upstream of the downstream end portion 13D of the conveying surface 13 in the conveying direction D1 and farther from the support surface 80A than the first end portion 60A of the inclined surface 60.

Since the friction member 65 illustrated in FIG. 10 has the substantially T-shape, the width of the second end portion 60B in the lateral direction (i.e., the right and left direction) is less than that of the first end portion 60A in the lateral direction and less than the width of the small-diameter portion 25C in the lateral direction. With this construction, in the case where the inclined surface 60 pivots about the first pivot axis X61, the second end portion 60B of the inclined surface 60 is movable into the small-diameter portion 25C (i.e., the space between the outer circumferential surfaces 25A) without contacting the outer circumferential surfaces 25A as indicated by the two-dot chain lines in FIG. 13.

A plane extending through the upstream end portion 13U of the conveying surface 13 in the conveying direction D1 and orthogonal to the support surface 80A is defined as a first imaginary plane K1. A plane extending through the downstream end portion 13D of the conveying surface 13 and orthogonal to the support surface 80A is defined as a second imaginary plane K2. The first end portion 60A and the first pivot axis X61 are located between the first imaginary plane K1 and the second imaginary plane K2.

Stoppers and Stopper Cams

As illustrated in FIGS. 3-7 and 12, the stoppers 40 and the stopper cams 50 are provided upstream of the separator 20 in the conveying direction D1. One pair of the stopper 40 and the stopper cam 50 and the other pair of the stopper 40 and the stopper cam 50 are provided on opposite sides of the separator 20 in the right and left direction in which the first rotation shaft 11S and the second rotation shaft 12S extend.

As illustrated in FIGS. 4 and 5, the stoppers 40 are supported in the second housing 9 so as to be pivotable about a third pivot axis X40. The third pivot axis X40 extends over the support surface 80A in the right and left direction. As illustrated in FIGS. 4 and 7, the stoppers 40 are exposed from the guide surface 90A and protrude downward.

The stoppers 40 are urged by a torsion coil spring 40T illustrated in FIG. 5 toward a first position illustrated in FIGS. 3, 4, 5, 7, and 13. As illustrated in FIG. 13, when located at the first position, the stoppers 40 are located upstream of the first end portion 60A of the inclined surface 60 in the conveying direction D1. As illustrated in FIG. 4, distal end portions 41 of the stoppers 40 extend to the support surface 80A and intersect the conveyance path P1 in a state in which the stoppers 40 are located at the first position.

When the distal end portions 41 are pushed toward the downstream side in the conveying direction D1, the stoppers 40 pivot about the third pivot axis X40 so as to move to a second position illustrated in FIG. 12. When the stoppers 40 are located at the second position, the distal end portions 41 of the stoppers 40 are separated from the support surface 80A.

As illustrated in FIG. 5, the left stopper cam 50 is connected to a left end portion of a cylindrical member 50A. The right stopper cam 50 is connected to a right end portion of the cylindrical member 50A. A transmission shaft 50S defining a fourth pivot axis X50 is inserted in the cylindrical member 50A in the first housing 8. The transmission shaft 50S is supported by the frame, not illustrated. The cylindrical member 50A is assembled to the transmission shaft 50S so as to be rotatable together with the transmission shaft 50S.

As illustrated in FIG. 4, the fourth pivot axis X50 is located below a portion of the back surface 80B of the lower chute 80 and extends in the right and left direction. The fourth pivot axis X50 is located upstream of the first rotation shaft 11S of the first supply rollers 11 and the second rotation shaft 12S of the second supply rollers 12 in the conveying direction D1 and farther from the support surface 80A than the first rotation shaft 11S and the second rotation shaft 12S.

The stopper cams 50 pivot about the fourth pivot axis X50 so as to move between a third position illustrated in FIGS. 2 and 4-6 and a fourth position illustrated in FIG. 12.

As illustrated in FIG. 5, a left end portion of the transmission shaft 50S is connected to the motor M1 via a one-way clutch C3. A torsion coil spring 59 illustrated in FIG. 5 urges the stopper cams 50 toward the fourth position illustrated in FIG. 12.

As illustrated in FIGS. 4 and 5, each of the stopper cams 50 includes a first portion 51 and a second portion 52. The first portion 51 extends from the fourth pivot axis X50 in the conveying direction D1. The first portions 51 are located farther from the support surface 80A than the first supply rollers 11 and the second supply rollers 12. The second portions 52 are respectively connected to downstream end portions 51D of the respective first portions 51 so as to extend upward toward the conveyance path P1. Each of the second portions 52 has a cutout 52C in its side surface that is opposed to the second rotation shaft 12S and located downstream of the second rotation shaft 12S in the conveying direction D1. The cutout 52C of the second portion 52 is substantially shaped like an arc that is recessed toward the downstream side in the conveying direction D1 so as to avoid the second rotation shaft 12S.

As illustrated in FIG. 12, a restrictor 89 is formed on the lower chute 80. The restrictor 89 is a rib opposed to the back surface 80B of the lower chute 80 and located farther from the support surface 80A than the first portions 51 of the stopper cams 50. The stopper cams 50 pivotable by the urging force of the torsion coil spring 59 illustrated in FIG. 5 are positioned at the fourth position illustrated in FIG. 12 when the first portions 51 are stopped by contacting the restrictor 89.

As illustrated in FIG. 5, reverse rotation of the motor M1 establishes a connected state of the one-way clutch C3, so that a driving force generated by the motor M1 is transmitted to the transmission shaft 50S and the cylindrical member 50A. As a result, the stopper cams 50 are moved to the third position against the urging force of the torsion coil spring 59.

In the present embodiment, the motor M1 is a stepping motor. The motor M1 is rotated reversely by a particular angle and then kept at the position in an energized state by control of the control board 2, whereby the stopper cams 50 are accurately kept at the third position.

When the motor M1 is rotated forwardly, the one-way clutch C3 becomes a disconnected state, so that no driving force is transmitted to the transmission shaft 50S and the cylindrical member 50A. As a result, the stopper cams 50 are urged by the torsion coil spring 59 and moved to the fourth position.

As illustrated in FIG. 4, when located at the third position, the stopper cams 50 are in contact with the distal end portions 41 of the respective stoppers 40 located at the first position, in a state in which distal ends of the stopper cams 50 are located downstream of the distal end portions 41 in the conveying direction D1, thereby limiting movement of the stoppers 40 to the second position.

As illustrated in FIG. 12, when located at the fourth position, the stopper cams 50 are spaced apart from the distal end portions 41 of the stoppers 40 located at the first position, thereby allowing movement of the stoppers 40 to the second position.

Image Reading Operation

When the image reading apparatus 1 is turned on, the control board 2 determines whether the sheet or sheets SH are supported on the support surface 80A, based on a position of the sheet sensor 19. When the control board 2 determines that the sheet or sheets SH are supported on the support surface 80A, the control board 2 notifies the user of information indicating that the sheets SH should be removed from the support surface 80A. When the control board 2 determines that no sheet SH is supported on the support surface 80A, the control board 2 rotates the motor M1 reversely by the particular angle to move the stopper cams 50 to the third position to situate the stoppers 40 at the first position. The control board 2 then changes a state of the image reading apparatus 1 to a standby state.

When the sheet or sheets SH are placed on the supply tray 5 and the support surface 80A by the user, the control board 2 recognizes this placement based on a change of the position of the sheet sensor 19. At this time, the stoppers 40 situated at the first position to prevent advance of the leading edges of the sheets SH supported on the support surface 80A. This construction reduces variations in positions of the leading edges of the sheets SH supported on the support surface 80A.

Upon reception of an instruction for performing the image reading operation, the control board 2 starts controlling the motor M1, the first reader 3A, and the second reader 3B. The control board 2 rotates the motor M1 forwardly to move the stopper cams 50 to the fourth position, thereby allowing movement of the stoppers 40 to the second position. The first supply rollers 11, the second supply rollers 12, the separating rollers 21, the first conveying rollers 31A, and the second conveying rollers 32A are rotated in directions in which the sheet SH is to be conveyed in the conveying direction D1.

As illustrated in FIG. 12, the sheet or sheets SH pressed onto the first supply rollers 11 by the pressing member 15 are conveyed by these rotated rollers toward the downstream side in the conveying direction D1. The conveyed sheet or sheets SH push the stoppers 40 to the second position. The sheet or sheets SH are conveyed through a wedge-shaped space defined by the support surface 80A, the conveying surface 13, and the inclined surface 60 and nipped by the separating rollers 21 and the retard rollers 25. In the case where a plurality of the sheets SH are conveyed, one sheet SH is separated from the other sheets SH by the separating rollers 21 and the retard rollers 25 and conveyed toward the downstream side in the conveying direction D1.

The first conveying rollers 31A and the first pinch rollers 31B convey the separated sheet SH toward the first reader 3A and the second reader 3B. The first reader 3A and the second reader 3B read an image formed on the sheet SH and transmit image information to the control board 2. The sheet SH for which image reading has been performed by the first reader 3A and the second reader 3B is discharged onto the output tray 6 by the second conveying rollers 32A and the second pinch rollers 32B.

At the end of the image reading operation, the control board 2 rotates the motor M1 reversely by the particular angle. This rotation moves the stopper cams 50 to the third position and situates the stoppers 40 to the first position. The control board 2 then changes the state of the image reading apparatus 1 to the standby state.

Operations and Effects

In the image reading apparatus 1 according to the embodiment, as illustrated in FIG. 12, in the case a plurality of the sheets SH are supplied, leading edges SH1 of the respective stacked sheets SH are brought into contact with the inclined surface 60 at a position located upstream of the nip position N1 in the conveying direction D1. In this state, the leading edges SH1 of the respective stacked sheets SH are located in the wedge-shaped space defined by the support surface 80A, the conveying surface 13, and the inclined surface 60, whereby the leading edges SH1 of the respective stacked sheets SH are reliably shaped into a wedge along the inclined surface 60. Since the inclined surface 60 is pivotable about the first pivot axis X61, it is possible to reduce jam of the stacked sheets SH by their leading edges SH1 caught by the inclined surface 60 and reduce buckling of the leading edge of the sheet SH in the state in which the leading edges SH1 of the respective stacked sheets SH are located in the wedge-shaped space. Also, since the second end portion 60B of the inclined surface 60 is spaced apart from the conveying surface 13, the number of the sheets SH is appropriately limited when the leading edges SH1 having the wedge-shape passes through an area between the conveying surface 13 and the second end portion 60B of the inclined surface 60. That is, in this image reading apparatus 1, the leading edges SH1 are reliably shaped into a wedge before the leading edges SH1 of the respective stacked sheets SH are brought into contact with the separating rollers 21 and the retard rollers 25. This operation accurately limits the number of the sheets SH reaching the nip position N1 and reduces the variations in positions of the leading edges of the sheets SH.

As illustrated in FIG. 13, the inclined surface 60 and the conveying surface 13 are spaced apart from each other, and the first end portion 60A and the first pivot axis X61 about which the inclined surface 60 is pivotable are located between the first imaginary plane K1 and the second imaginary plane K2. Thus, the leading edges SH1 are further reliably shaped into a wedge before the leading edges SH1 of the respective stacked sheets SH are brought into contact with the separating rollers 21 and the retard rollers 25. This operation accurately limits the number of the sheets SH reaching the nip position N1 and reduces the variations in positions of the leading edges of the sheets SH. This improves separation of the sheets SH at the nip position N1 of the separating rollers 21 and the retard rollers 25.

Accordingly, it is possible to reliably reduce double feeding of the sheets SH.

In the image reading apparatus 1, as illustrated in FIG. 13, the inclined surface 60 is kept at the initial position by the urging force of the urging member 69 in the state in which the inclined surface 60 is not in contact with the sheets SH to be supplied. Moreover, the first pivot axis X61 is located upstream of the downstream end portion 13D of the conveying surface 13 in the conveying direction D1 and farther from the support surface 80A than the first end portion 60A of the inclined surface 60.

With these constructions, the inclined surface 60 pivotable about the first pivot axis X61 acts on the various numbers of the sheets SH well, thereby shaping the leading edges SH1 into a wedge. Also, even in the case where the thickness of the leading edges SH1 of the stacked sheets SH is greater than the distance between the conveying surface 13 and the second end portion 60B of the inclined surface 60 when the wedge-shaped leading edges SH1 passes through the area between the conveying surface 13 and the second end portion 60B, the inclined surface 60 is moved toward the downstream side in the conveying direction D1 away from the leading edges SH1 of the stacked sheets SH, thereby preventing jam and buckling of the sheets SH. Also, even in the case where a thick medium, such as a plastic card, passes through the area between the conveying surface 13 and the second end portion 60B of the inclined surface 60, the inclined surface 60 is moved toward the downstream side in the conveying direction D1 away from a leading edge of the thick medium, thereby preventing rotation of the supply rollers without conveying the thick medium.

In this image reading apparatus 1, as illustrated in FIG. 13, in the state in which the inclined surface 60 is located at the initial position, the second end portion 60B of the inclined surface 60 intersects the tangent S1 extending parallel with the support surface 80A and contacting the conveying surface 13 and extends toward the support surface 80A.

This construction enables the inclined surface 60 to well act on a small number of the sheets SH to shape the leading edges of the sheets SH into a wedge, thereby reducing the double feeding of the sheets SH more reliably.

In this image reading apparatus 1, as illustrated in FIG. 13, the supplier 10 includes the first supply rollers 11, the second supply rollers 12, and the pressing member 15. The conveying surface 13 is constituted by (i) the portions of the first cylindrical surfaces 11A which are exposed from the support surface 80A and (ii) the portions of the second cylindrical surfaces 12A which are exposed from the support surface 80A.

With this construction, as illustrated in FIG. 12, the sheets SH supported on the support surface 80A are accurately conveyed toward the nip position N1 by the first and second supply rollers 11, 12 and the pressing member 15. The conveyed sheets SH are nipped by the separating rollers 21 and the retard rollers 25 at the nip position N1, nipped by the first and second supply rollers 11, 12 and the pressing member 15 at an area located upstream of the nip position N1 in the conveying direction D1, and pressed by the inclined surface 60 onto the second cylindrical surfaces 12A of the second supply rollers 12 at an area between the nip position N1 and the nip area located upstream of the nip position N1 in the conveying direction D1. As a result, the leading edges SH1 of the respective stacked sheets SH are more reliably shaped into a wedge, thereby more accurately limiting the number of the sheets SH reaching the nip position N1 and further reducing the variations in positions of the leading edges of the sheets SH.

In this image reading apparatus 1, as illustrated in FIG. 13, the first cylindrical surfaces 11A and the second cylindrical surfaces 12A overlap each other when viewed in the direction in which the first rotation axis X11 and the second rotation axis X12 extend.

This construction reduces the size of the hollow between the portion of each of the first cylindrical surfaces 11A which is exposed from the support surface 80A and the portion of the corresponding second cylindrical surface 12A which is exposed from the support surface 80A, i.e., the hollow formed on the conveying surface 13. The conveying surface 13 having this construction well conveys the sheets SH to the nip position N1.

In this image reading apparatus 1, as illustrated in FIG. 12, the sheets SH supported on the support surface 80A are accurately conveyed toward the nip position N1 by cooperation of the first supply rollers 11 and the simple pressing member 15 including the arm 16 and the rotation members 17.

In this image reading apparatus 1, as indicated by the two-dot chain line in FIG. 13, in the case where the inclined surface 60 pivots from the initial position about the first pivot axis X61, the second end portion 60B of the inclined surface 60 is movable into the small-diameter portion 25C (i.e., the space between the outer circumferential surfaces 25A) without contacting the outer circumferential surfaces 25A.

This construction enables the second end portion 60B of the inclined surface 60 to move toward the nip position N1. Accordingly, the sheets SH are accurately guided by the inclined surface 60 to a position near the nip position N1, thereby reducing jam of the sheets SH just before the nip position N1.

In this image reading apparatus 1, as illustrated in FIG. 4, the distal end portions 41 of the stoppers 40 situated at the first position intersect the conveyance path P1 in the standby state of the image reading apparatus 1 to prevent advance of the leading edges of the sheets SH supported on the support surface 80A. In the image reading operation, as illustrated in FIG. 12, the stoppers 40 are moved to the second position to move their distal end portions 41 separated from the support surface 80A, thereby allowing passage of the sheets SH.

This construction prevents the sheets SH supported on the support surface 80A from advancing toward the separator 20 beyond the position of the distal end portions 41 of the stoppers 40 before the sheets SH are supplied by the supplier 10. Moreover, when the sheets SH are supplied by the supplier 10, the leading edges of the sheets SH are conveyed toward the inclined surface 60, thereby functioning the inclined surface 60 well.

In this image reading apparatus 1, as illustrated in FIG. 5, the retard rollers 25 include the torque limiter 29. In the case where a single sheet SH is supplied, the retard rollers 25 are rotated by rotation of the separating rollers 21 to convey the sheet SH in the conveying direction D1. In the case where a plurality of the sheets SH are supplied, rotation of the retard rollers 25 is stopped, so that a separating force in a direction reverse to the conveying direction D1 is applied to the sheet or sheets SH other than the sheet SH contacting the separating rollers 21.

That is, in this image reading apparatus 1, the retard rollers 25 are passive rollers which are not driven directly, resulting in reduction in size and manufacturing cost. Also, the operations of the inclined surface 60 effectively reduce the double feeding of the sheets SH.

In this image reading apparatus 1, the inclined surface 60 is constituted by the surface of the friction member 65 mounted on the holder 61.

That is, in this image reading apparatus 1, the inclined surface 60 is constituted by the friction member 65 allowing easily setting of the coefficient of friction on the sheet SH. This construction further accurately limits the number of the sheets SH reaching the nip position N1 and further reduces the variations in positions of the leading edges of the sheets SH.

In this image reading apparatus 1, as illustrated in FIG. 7, the opening 95H for exposing the retard rollers 25 is formed in the cover 95 mounted on the upper chute 90 so as to be openable and closable. Also, the holder 61 is pivotably mounted on the cover 95.

As illustrated in FIG. 8, this construction allows the user to open the cover 95 to move the holder 61 and the inclined surface 60 away from the retard rollers 25, resulting in easy maintenance of the retard rollers 25.

While the embodiment has been described above, it is to be understood that the disclosure is not limited to the details of the illustrated embodiment, but may be embodied with various changes and modifications, which may occur to those skilled in the art, without departing from the spirit and scope of the disclosure.

While the inclined surface 60 is located above the conveyance path P1, and the support surface 80A and the conveying surface 13 are located below the conveyance path P1 in the above-described embodiment, this positional relationship may be reversed. This image reading apparatus 1 may be configured such that the components to be directly driven by the motor are disposed in the housing in which the motor is disposed, and the components not to be directly driven by the motor are disposed in the housing in which the motor is not disposed.

While the separating rollers 21 and the support surface 80A are disposed on the same side of the conveyance path P1, and the retard rollers 25 are disposed on an opposite side of the conveyance path P1 from the support surface 80A in the above-described embodiment, this positional relationship may be reversed.

The conveying surface may be a portion of a surface of an endless belt, which portion is exposed from the support surface. The retard rollers may apply a separating force by being driven by the motor.

The support surface may have any construction as long as the support surface extends toward the downstream side in the conveying direction D1 so as to be capable of supporting not only the sheets SH whose leading edges are stopped by the stoppers 40 but also the sheets SH located at the nip position N1.

The present disclosure may be applied to image reading apparatuses, image forming apparatuses, and multi-function peripherals, for example.

What is claimed is:

1. A sheet conveying apparatus, comprising:

a supporter comprising a support surface configured to support a plurality of sheets thereon;

a supplier comprising a conveying surface exposed from the support surface, the conveying surface being configured to supply one or more sheets on the support surface downstream in a conveying direction along a conveyance path by moving, in the conveying direction, in contact with the one or more sheets on the support surface;

a separator comprising a separating roller and a retard roller which are located downstream of the supplier in the conveying direction, the separator being configured to separate one by one the one or more sheets supplied by the supplier at a nip position of the separating roller and the retard roller and convey the separated sheet downstream in the conveying direction;

a stopper disposed upstream of the nip position in the conveying direction and pivotable between a first position and a second position about a first pivot axis extending in a direction orthogonal to the conveying direction: and an inclined surface disposed upstream of the nip position in the conveying direction and pivotable between an initial position and a pivoted position about a second pivot axis extending in a direction orthogonal to the conveying direction, wherein when the stopper is located at the first position, the stopper intersects the conveyance path, extends to the support surface, and stops the plurality of sheets supported on the support surface from moving in the conveying direction toward the inclined surface, and the inclined surface is located at the initial position and is out of contact with the plurality of sheets stopped by the stopper, one end of the inclined surface at the initial position being within the conveyance path, spaced apart from the support surface, and downstream of the conveying surface in the conveying direction.

2. The sheet conveying apparatus according to claim 1, wherein the inclined surface is kept at the initial position by an urging force of an urging member in a state in which the inclined surface is out of contact with the one or more sheets to be supplied by the supplier, and wherein the second pivot axis of the inclined surface is located upstream of a downstream end portion of the conveying surface in the conveying direction and farther from the support surface than the one end of the inclined surface.

3. The sheet conveying apparatus according to claim 2, further comprising a limiter configured to limit movement of the inclined surface from the initial position toward the conveying surface by the urging force of the urging member.

4. The sheet conveying apparatus according to claim 2, wherein when viewed in a direction in which the second pivot axis extends, the one end of the inclined surface at the initial position intersects a tangent touching the conveying surface and extending parallel with the support surface.

5. The sheet conveying apparatus according to claim 1, wherein the supplier comprises:

a first supply roller comprising a first cylindrical surface and rotatable about a first rotation axis located opposite to the second pivot axis relative to the support surface, a portion of the first cylindrical surface being exposed from the support surface;

a second supply roller disposed downstream of the first supply roller in the conveying direction, comprising a second cylindrical surface, and rotatable about a second rotation axis located opposite to the second pivot axis relative to the support surface, a portion of the second cylindrical surface being exposed from the support surface; and a pressing member facing the support surface and the conveying surface, and wherein the conveying surface is constituted by the portion of the first cylindrical surface which is exposed from the support surface and the portion of the second cylindrical surface which is exposed from the support surface.

6. The sheet conveying apparatus according to claim 5, wherein the first cylindrical surface and the second cylindrical surface overlap each other when viewed in a direction in which the first rotation axis and the second rotation axis extend.

7. The sheet conveying apparatus according to claim 5, wherein the pressing member comprises:

an arm pivotable about a third pivot axis located upstream of the first supply roller in the conveying direction; and a rotation member rotatably supported by the arm at a position located downstream of the third pivot axis in the conveying direction, the rotation member facing the first cylindrical surface and contactable with the plurality of sheets.

8. The sheet conveying apparatus according to claim 1, wherein the support surface defines a portion of the conveyance path and extends to a position located downstream of the separator in the conveying direction, wherein the separating roller is rotatable about a third rotation axis located opposite to the second pivot axis relative to the support surface, wherein the retard roller is rotatable about a fourth rotation axis located opposite to the third rotation axis relative to the support surface, wherein the retard roller comprises two outer circumferential surfaces spaced apart from each other in a direction in which the fourth rotation axis extends, and wherein when the inclined surface pivots about the second pivot axis, the one end of the inclined surface is movable into a space between the two outer circumferential surfaces without contacting the two outer circumferential surfaces.

9. The sheet conveying apparatus according to claim 1, wherein when the supplier and the separator are not operated, the stopper is located at the first position, and wherein when the supplier and the separator are operated, the stopper is located at the second position and separated from the support surface.

10. The sheet conveying apparatus according to claim 1, wherein the retard roller comprises a torque limiter, wherein when the supplier supplies one sheet, the retard roller is rotated by rotation of the separating roller to convey the one sheet in the conveying direction, and wherein when the supplier supplies two or more sheets, the retard roller is not rotated to apply a separating force to sheets other than a sheet contacting the separating roller, and the separating force acts in a direction opposite to the conveying direction.

11. The sheet conveying apparatus according to claim 1, further comprising:

a holder pivotable about the second pivot axis; and a friction member mounted on the holder, wherein the inclined surface is constituted by a surface of the friction member.

12. The sheet conveying apparatus according to claim 11, further comprising:

a chute configured to define a portion of the conveyance path and expose a portion of an outer circumferential surface of the retard roller; and a cover mounted on the chute so as to be openable and closable, the cover defining a portion of the conveyance path in a state in which the cover is closed, the cover comprising an opening that exposes the retard roller, wherein the holder is pivotably mounted on the cover.

13. The sheet conveying apparatus according to claim 1, wherein the inclined surface is farther from the conveying surface of the supplier at the pivoted position than at the initial position.

14. The sheet conveying apparatus according to claim 1, wherein when the inclined surface is located at the initial position, the second pivot axis and the one end are located between (i) a first imaginary plane orthogonal to the support surface and extending through an upstream end portion of the conveying surface in the conveying direction and (ii) a second imaginary plane orthogonal to the support surface and extending through a downstream end portion of the conveying surface in the conveying direction.

15. A sheet conveying apparatus, comprising:

a supporter comprising a support surface configured to support a plurality of sheets thereon;

a supplier comprising a conveying surface exposed from the support surface, the conveying surface being configured to supply one or more sheets on the support surface a downstream in a conveying direction along a conveyance path by moving, in the conveying direction, in contact with the one or more sheets on the support surface;

a separator disposed downstream of the supplier in the conveying direction and configured to separate one by one the one or more sheets supplied by the supplier and convey the separated sheet downstream in the conveying direction;

a first stopper and a second stopper, each disposed upstream of the separator in the conveying direction, each having a contact surface, and each pivotable, about a pivot axis extending in an orthogonal direction which is orthogonal to the conveying direction, between a first position and a second position relative to the support surface; and an inclined surface disposed upstream of the separator in the conveying direction and disposed between the first stopper and the second stopper in the orthogonal direction, the inclined surface being pivotable, about a second pivot axis extending in the orthogonal direction, between an initial position and a pivoted position relative to the conveying surface, wherein when each of the first stopper and the second stopper is located at the first position, the contact surface of each of the first stopper and the second stopper extends to the support surface and is in contact with leading edges of the plurality of sheets supported on the support surface, and the inclined surface is located at the initial position, is out of contact with the leading edges of the plurality of sheets, and is downstream in the conveying direction of the contact surface of each of the first stopper and the second stopper.

16. The sheet conveying apparatus, according to claim 15, wherein when each of the first stopper and the second stopper is located at the second position, the contact surface of each of the first stopper and the second stopper is separated from the support surface, and the inclined surface guides the one or more sheets supplied by the supplier and is pivoted by the one or more sheets in a direction away from the conveying surface toward the pivoted position.

* * * * *